United States Patent [19]

Stuhr

[11] Patent Number: 4,528,814

[45] Date of Patent: Jul. 16, 1985

[54] HYDROSTATIC DRIVE SYSTEMS

[75] Inventor: Hans-Waldemar Stuhr, Aschaffenburg, Fed. Rep. of Germany

[73] Assignee: Linde Aktiengesellschaft, Wiesbaden, Fed. Rep. of Germany

[21] Appl. No.: 404,510

[22] Filed: Aug. 2, 1982

[30] Foreign Application Priority Data

Aug. 3, 1981 [DE] Fed. Rep. of Germany ..... 3130661

[51] Int. Cl.[3] ..... F16D 33/02

[52] U.S. Cl. ..... 60/419; 60/428; 60/446; 60/448

[58] Field of Search ..... 60/419, 428, 446, 448, 60/384, 911

[56] References Cited

U.S. PATENT DOCUMENTS 3,948,049 4/1976 Ohms et al. ..... 60/428

4,215,543 8/1980 Miller ..... 60/911

4,359,130 11/1982 Kirkham ..... 60/428

*Primary Examiner*—Robert E. Garrett

*Assistant Examiner*—John M. Husar

*Attorney, Agent, or Firm*—Buell, Ziesenheim, Beck & Alstadt

[57] ABSTRACT

A hydrostatic drive in which the ratio of pressure to force is constant is provided having a consumer of hydraulic energy connected to a high pressure system line, a first displacement means interposed between the consumer and the pressure system line, speed regulating means acting on the first displacement means to regulate the speed thereof, a second displacement means connected to the first displacement means by a drive shaft and receiving fluid from the pressure system line, volume output adjusting means acting on one of said first and second displacement means to adjust the volume output per revolution and coupling means connecting the adjustable displacement means with the consumer of hydraulic energy.

8 Claims, 7 Drawing Figures

HYDROSTATIC DRIVE SYSTEMS

This invention relates to hydrostatic drive systems and particularly to a hydrostatic drive system with a consumer of hydraulic energy, in which the ratio between pressure and force or torque is constant and when the hydraulic energy consumer is connected to a pressure system in which a pressure is maintained as constant as possible and a stream that is particularly unlimited with regard to the consumer can flow. More particularly, the invention relates to such a hydrostatic drive system where a displacement machine with rotating shaft and connected with a speed-control device is provided for arbitrary regulation of the speed of movement of the consumer, to the shaft of which displacement machine a second displacement machine with rotating shaft is connected, in which one of the displacement machines with rotating shaft is adjustable with respect to stroke volume per revolution.

In an arrangement of this type that has been proposed in German Application No. P 31 30 659.4, but is not yet known through publication, a displacement machine with rotating shaft whose stroke volume per revolution is constant, and a cylinder in which the piston acting as the consumer is capable of sliding are connected one behind the other between the pressure system line and a low-pressure line, and a second displacement machine that is adjustable is connected parallel to them, in which case its setting is influenced by the speed-regulating device which can be arbitrarily influenced.

The present invention proposes to optimize the energy flow in a drive system of the above type by improvements and further refinements and to keep the energy loss as low as possible. For solving this problem, it is primarily provided that the adjustable displacement machine be coupled with the consumer of hydrostatic energy. This coupling can be effected in various ways: purely mechanically on the one hand and, on the other, preferably through the fact that the adjustable displacement machine is connected with the line conveying the pressure medium to the consumer of hydrostatic energy. In the case of mechanical coupling, the consumer of hydrostatic energy can itself be the displacement machine that is constant with regard to stroke volume per revolution, inasmuch as it is necessary for technical reasons to drive the consumer of mechanical energy by a displacement machine with a constant stroke volume per revolution, although a second adjustable displacement machine of at least approximately the same size is required for regulation.

It is considered particularly advantageous that the adjustable displacement machine be connected between the pressure system line and the consumer of hydrostatic energy, where the consumer of hydrostatic energy is preferably a piston capable of sliding in a cylinder in this case.

In another particularly advantageous refinement form, in a drive system in which the consumer is a piston capable of sliding in a cylinder and a displacement machine with constant stroke volume per revolution is connected in the feed line to the cylinder, the shaft of which is coupled with the adjustable displacement machine, it can be provided that the suction connection of the second displacement machine be connected with the connecting line between the first displacement machine and the cylinder. This results in a dual coupling of the energy flow path. Since the second displacement machine is driven by the first displacement machine, a pressure gradient is produced in the first displacement machine, as in the arrangement already proposed, and it corresponds to the energy proportion mechanically removed from the stream of pressure medium at the shaft. On the other hand, pressure medium is also removed by the second displacement machine from the stream of pressure medium between the first displacement machine and the energy consumer so that only a stream reduced by an amount corresponding to the stream removed flows to the consumer. As a result, in contrast to the arrangement already proposed, in which the second displacement machine draws from the low-pressure line, in the arrangement according to the invention the second displacement machine can be smaller. Because the energy losses in a displacement machine are dependent on its size, the overall energy losses by the two displacement machines are thus smaller in the arrangement according to the present invention than in the solution already previously proposed. Besides this effect on the energy flow side, there is also a second difference as compared with the solution already proposed, in that in the solution already proposed the speed of the hydrostatic energy consumer was determined by the r.p.m. of the shaft common to the two displacement machines. In contrast, in the arrangement according to the present invention the speed of movement of the hydrostatic energy consumer is also dependent on the setting given the adjustable displacement unit, with the result that this setting must also be considered in regulating the speed. The energy transferred in the shaft is less than in the solution proposed, also as a result of the higher pressure of the pressure medium flowing to the second unit.

As mentioned above, it is provided in the drive system already proposed that a displacement machine with a constant stroke volume per revolution and with a rotating shaft is connected between the pressure system line and the hydraulic energy consumer, in which case this shaft is loaded by a definite arbitrarily selected torque, where the r.p.m. regulating device is provided with an auxiliary control pump in the feed line of which a restrictor is located. In a drive system according to the present invention, in which the displacement machine connected between the pressure system line and the hydraulic energy consumer is adjustable, a particularly advantageous refinement results if the definite loading of the shaft is applied by the auxiliary control pump, such that only one additional displacement machine is required for speed regulation in addition to the auxiliary control pump. For this purpose, it is provided according to this additional step of the invention that the second displacement machine, which is driven by the first, is the auxiliary control pump and that its suction line is connected to a low-pressure line and its control pressure feed line is connected to the pressure system line, where the restrictor provided for producing an r.p m.-dependent signal is connected in the control pressure feed line between the auxiliary control pump and the pressure system line and the pressure gradient as it acts on a regulating device for the adjustable displacement machine. Indeed, a throttling is again necessitated in a relatively large stream but, since the throttling here is required merely to produce a signal, it can be relatively weak and the stream can be considerably smaller than the main stream flowing to the consumer since only the energy not flowing to the consumer is to be drawn off through this stream. This is particularly true if in another variant according to the already-mentioned concept the suction line of the auxiliary control pump is connected to the connecting line between the adjustable displacement machine and the cylinder. The restrictor is preferably adjustable here in order to specify the theoretical speed.

Especially in the said case, in which the second displacement unit draws from the line between the first displacement unit and the cylinder, it can be provided in another advantageous refinement that a sensor is provided for controlling the speed of the piston in the cylinder, with which the position of the piston is determined and which sends a signal to a regulating computing mechanism, which deduces a comparison signal from the change in position of the piston in the cylinder per unit of time, i.e., the speed of piston movement (which at the same time is a measure of the stream volume flowing into the cylinder), by comparison with a given, e.g., arbitrarily predetermined theoretical speed value signal, which, if this signal does not equal zero, acts on the adjusting element of the adjustable displacement machine. If expedient, it can also be provided for the setting of the adjustable displacement machine to act on the regulating computing mechanism also.

In the foregoing general statement of this invention, I have set out certain objects, purposes and advantages of this invention. Other objects, purposes and advantages of this invention will be apparent from a consideration of the following description and the accompanying drawings showing circuit diagrams of four embodiments of this invention in which.

Figure 1:
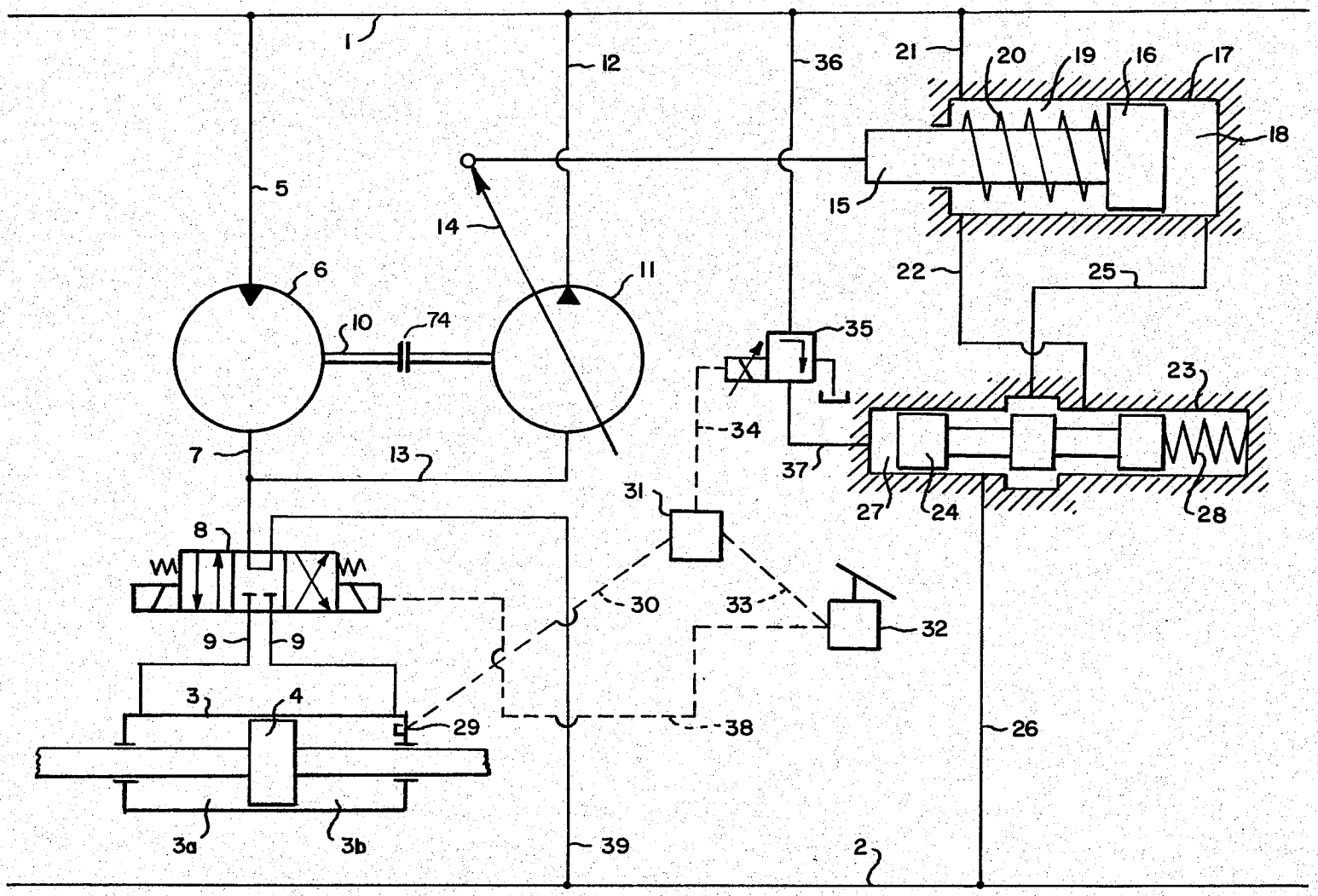
FIG. 1 shows a drive system with a piston capable of sliding in a cylinder and two displacement machines.

Referring to the drawings, the pressure system 1 is supplied with pressure medium having as constant a pressure as possible by a pump (not shown in the drawing), where the maximum incoming pressure medium stream is large as compared with the maximum stream that the sum of consumers can handle.

The low-pressure line 2 is always filled with pressure medium under low pressure.

The piston 4, whose piston rod is connected with a consumer of mechanical energy, is capable of sliding in cylinder 3.

A constant-speed motor 6 is connected to the line 5 as the first displacement machine. To this motor 6, the connecting line 7 is connected; it leads to a 3-position 4-connection valve ($\frac{3}{4}$-way valve), from which the two lines 9 lead to the two pressure chambers 3*a* and 3*b* of cylinder 3. Valve 8 thus serves to determine the direction of movement of the piston 4.

The hydraulic motor 6 is connected through the shaft 10 with an adjustable pump 11 (second displacement machine), whose feed line 12 is also connected to the pressure system line 1 and whose suction line 13 is connected to the connecting line 7. The regulating unit 14 of the adjustable hydraulic pump 11 is connected with the regulating piston rod 15 of a regulating piston 16, which is capable of sliding in a regulating cylinder 17 in which two pressure chambers 18 and 19 are formed by the regulating piston 16, where a spring 20 is located in the pressure chamber 19, normally urging piston 16 to the right, viewing FIG. 1. Pressure chamber 19 is connected through a line 21 to the pressure system line 1, where the pressure medium flows from the latter through line 21 and the pressure chamber 19 into line 22, which leads to a regulating valve 23, in which a regulating piston 24 is capable of sliding and to which a connecting line 25, which empties into the pressure chamber 18 of the regulating cylinder 17, is connected, and a drain line 26, which leads to the low-pressure line 2.

A pressure chamber 27 is formed in the regulating valve 23. The pressure prevailing in it acts on one end surface of the regulating piston 24, while the other side rests against a spring 28 in a pressureless chamber which spring 28 normally urges piston 24 to the left, viewing FIG. 1.

A sensor 29 is located at one end of the cylinder 3; it continuously sends a signal through a signal line 30 to the regulating computing mechanism 31, in which case the size of this signal is proportional to the distance of piston 4 from the sensor 29. The sensor 29 may be any of the well known sensor systems by which the position of the piston in the cylinder can be established. For example, a potentiometer system such as that of Miller U.S. Pat. No. 4,215,543 with a resistance that can be read off at arbitrary sites may be used. Another system would provide the piston rod with magnet markings and a magnetic sensor in the piston head beside the piston rod so that the magnets passing sensor during displacement of the piston rod impart pulses in the sensor which can be read, e.g. DE-OS No. 33 24 584; DE-PS No. 29 33 557 and Fluid Markt 81/82, page 24.

Through an actuating device 32 an arbitrarily selectable theoretical value signal can be sent continuously, which signal is conveyed through a signal line 33 also to be regulating computing mechanism 31, which acts through a signal line 34 on a pressure control valve 35, which is connected to a line 36, which in turn is also connected to the pressure system line 1. The pressure control valve 35 determines the pressure in line 37 and thus in the pressure chamber 27.

Another signal line 38 leads from the actuating element 32 to the solenoid of valve 8.

In the position shown in the drawing the valve 8 is in its closed position and the pump 11 is in its zero-stroke position or in a position in which it imparts the same torque to the shaft 10 as the hydraulic motor 6. The apparatus is in the resting state.

Now if a signal is transmitted through the theoretical value setter, valve 8 is opened on the one hand and a theoretical value for the speed of movement of piston 4 is sent to the regulating computing mechanism 31 on the other. A stream flows through line 5, hydraulic motor 6, connecting line 7, valve 8, and one of lines 9 into the cylinder 3. The hydraulic motor 6 is thus rotated and through shaft 10 drives the hydraulic pump 11, which draws pressure medium through suction line 13 from the connecting line 7 and feeds it back into the pressure system line 1 through line 12. The speed of movement of piston 4 is thus determined by the r.p.m. of shaft 10 and the setting imparted to the hydraulic pump 11. However, this setting is again determined by the pressure in line 37, which is determined by the pressure control valve 35, which in turn is influenced by the regulating computing mechanism 31.

If the force exerted by the pressure in pressure chamber 27 on the front face of regulating piston 24 is as great as the force exerted by spring 28 on the other face of regulating piston 24 when the latter is in its neutral position, the middle section of regulating piston 24 closes off the annular groove into which line 25 empties in the regulating valve 23, and thus the pressure chamber 18 of regulating cylinder 17 is closed off. The regulating device consequently does not move. If the pressure in pressure chamber 27 is reduced through the pressure control valve 35 due to a signal from the regulating computing mechanism 31, the force of the spring 28 displaces the regulating piston 24 to the left in the drawing so that lines 22 and 25 are connected together through the recess in the regulating piston 24 (on the right in the drawing) and thus pressure from the pressure system line 1 is conveyed into the pressure chamber 18 in front of the large piston surface of regulating piston 16 so that the latter is shifted to the left according to the drawing. Inversely, if the pressure in line 37 is increased through the pressure control valve 35, the regulating piston 24 is shifted toward the right in the drawing and line 25 is connected with line 26 and thus pressure medium is let out of the pressure chamber 18 of regulating cylinder 17.

It is sufficient if a signal is sent by the actuating mechanism 32 when the theoretical value varies.

The two displacement machines 6 and 11 can be smaller than in the arrangement already proposed: since the pump 11 can feed into line 7 through line 13 if it is adjustable beyond the neutral position, the maximum stream flowing to cylinder 3 does not need to flow through the hydraulic motor 6. Since the stoppage of piston 4 can be controlled by stoppage of shaft 10, pump 11 needs to receive only a portion of the stream of hydraulic motor 6. In a variant not shown in the drawing it is provided that line 13 can be separated from line 7 and connected with line 39 through a change-over valve so that pump 11 can be set at the full pressure gradient in order to receive a greater rotation energy.

Figure 2:
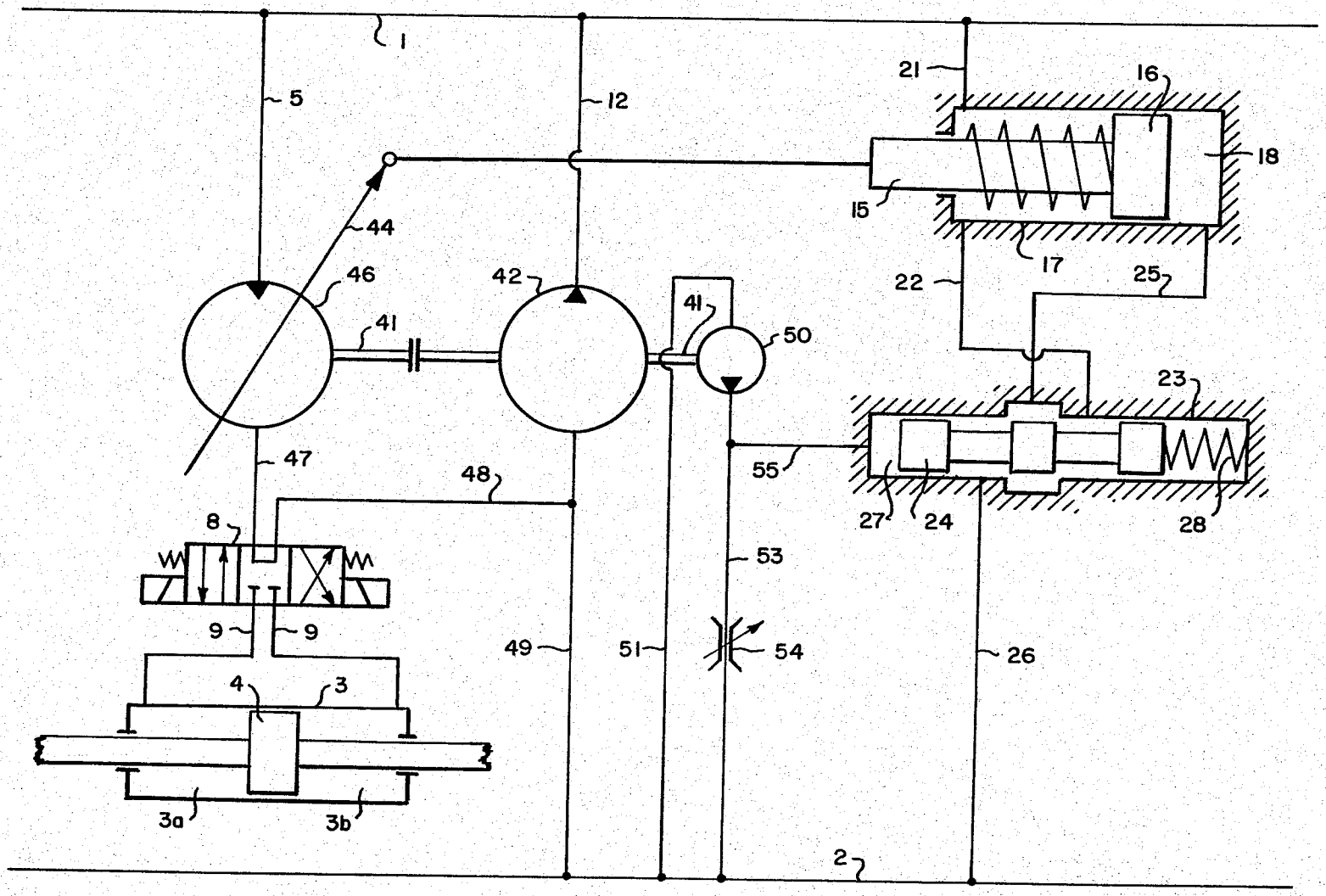
FIG. 2 shows a drive system with a piston capable of sliding in a cylinder and two displacement machines in another arrangement.

The components in FIG. 2 that coincide with the components in FIG. 1 have the same reference numbers. The embodiment according to FIG. 2 differs from that of FIG. 1 in that the adjustable displacement machine 46 is connected between the pressure system line 1 and cylinder 3. This means that the adjustable displacement machine 46 is connected to line 5 and from machine 46 the connecting line 47 leads to the valve 8 that is connected through line 9 with cylinder 3. The regulating element 44 of the adjustable displacement machine 46 is connected with the piston rod 15 of regulating piston 16. The shaft 41 connects the adjustable displacement machine 46 with the constant pump 42 that is connected to line 12 and draws from line 49, from which a connecting line 48 leads to the valve 8.

The torque at the shaft 41, by which the constant pump 42 is driven, is determined at given pressure gradients between the lines 5 and 47 by the setting given the adjustable displacement machine 46. The stream flowing to the cylinder 3 through the connecting line 47 is determined by the r.p.m. of shaft 41 and by the setting given the adjustable displacement machine 46, which in turn is determined by the arrangement 15–28. In this case the pressure in the pressure chamber 27 is determined as a function of the r.p.m. of shaft 41, where an auxiliary control pump 50 is connected to this shaft 41, which draws from line 2 through a line 51 and impels into a control pressure feed line 53, in which an adjustable restrictor 54 is located. At a certain r.p.m. of the shaft 41 the auxiliary control pump 50 designed as a constant pump feeds a definite stream into the control pressure feed line 53 and thus to the restrictor 44, where a definite pressure is produced at a given setting imparted to the restrictor 54 and a given stream in the control pressure feed line 53, supplied by the auxiliary control pump 50; this pressure also acts in the pressure chamber 27 through the line 55. Since the regulation functions illustrated in connection with FIG. 1 arise at the control valve 23 and regulating cylinder 17, the shaft 41 is regulated to a constant r.p.m. at a given setting of the restrictor 54.

In particular, if an answer-back signal for the position of the final control element 54 or the regulating piston rod 15 is also given to the control valve in such a case, the speed of movement of piston 4 can thus be controlled by the arrangement.

Figure 3:
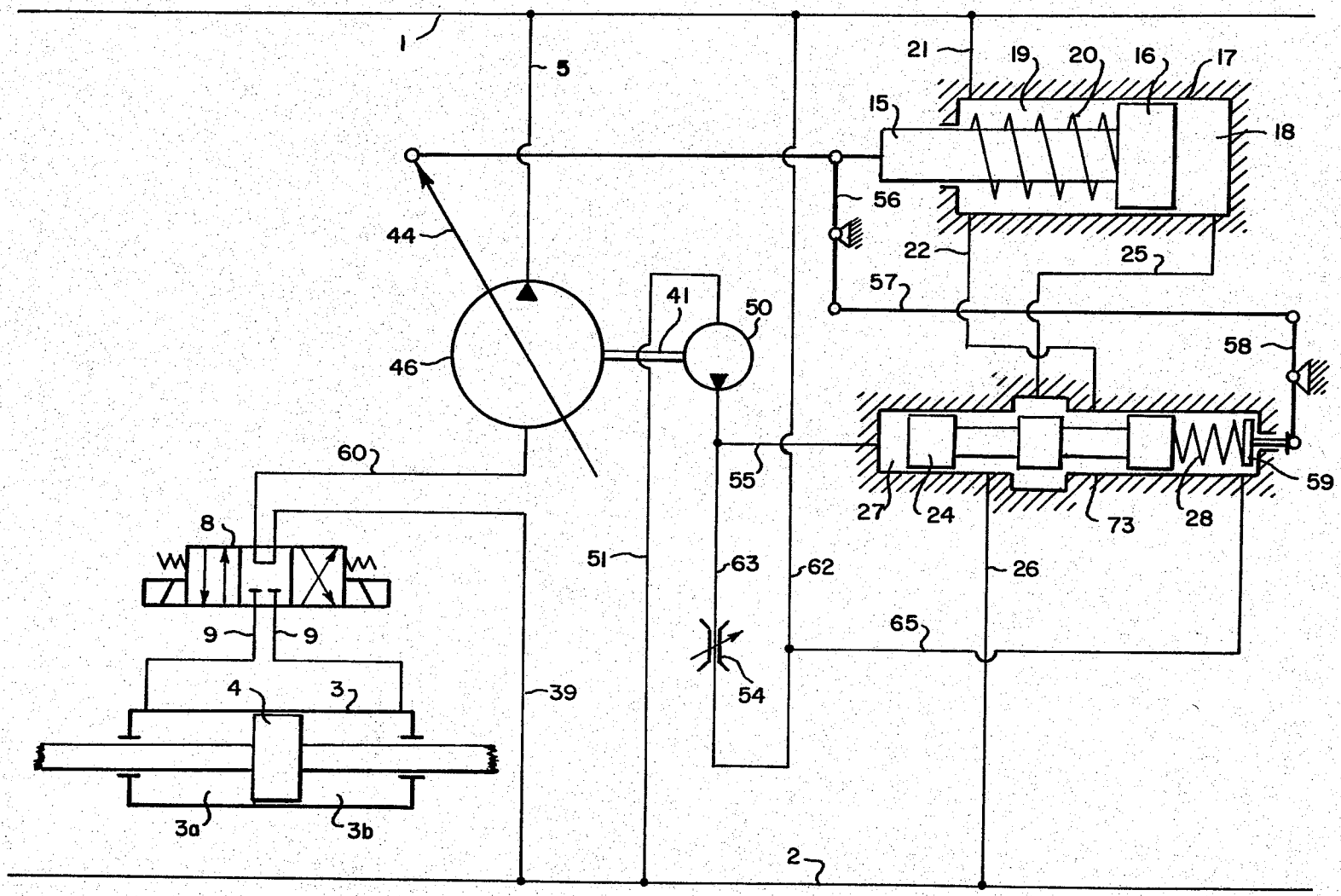
FIG. 3 shows a drive system with a piston capable of sliding in a cylinder and a displacement machine with auxiliary control pump.

Such a position answer-back arrangement is shown in FIG. 3 with the components 56–59.

In the embodiment according to FIG. 3 the components that bear the same reference numbers as the components in one of the preceding figures are identical with these components shown in the preceding figures.

An adjustable displacement machine 46 is again connected to the pressure system line 1 through the line 5; its setting member 44 is connected with the regulating piston rod 15 of the regulating piston 16, which is capable of sliding in regulating cylinder 17. A connecting line 60 leads from the adjustable displacement machine 46 to the valve 8 and from the latter through one of the lines 9 to the cylinder 3, where the other of the two lines 9 is a return line that is connected with the drain line 39 through the valve 8, drain line 39 being connected with line 2. The auxiliary control pump 50 is again connected to the shaft 41 of the adjustable displacement machine 46 and it draws from line 51. In this embodiment, however, no other displacement machine is connected to the shaft 41. The auxiliary control pump feeds into the control pressure feed line 63, which extends beyond the restrictor 54 in the line 62, which (in contrast to the embodiment according to FIG. 2) is connected to the pressure system line 1, i.e., the auxiliary control pump 50 pushes against the pressure in the pressure system line 1.

The setting of the final control element 44 of the adjustable displacement unit 46 is transferred through the piston rod 15, the two-armed lever 56 supported in a hinged bearing solid in the housing, the connecting rod 57, and the second lever 58 which is also supported in a hinged bearing solid in the housing, to the spring plate 59, against which the spring 28 rests. The control valve 73 differs from control valve 23 only in that the position of the regulating piston 24 is determined not only by the pressure in the pressure chamber 27, but also by the position of the spring plate 59 and thus the pretension of spring 28. Furthermore, in the case of the control valve 73 the pressure chamber on the right in the drawing is also loaded with pressure through line 65 so that the compression forces acting on both faces of the regulating piston 24 are determined by the pressure gradient at the adjustable restrictor 54. The stream flowing to cylinder 3 through line 60 is thus determined by the r.p.m. of the displacement machine 46 and by the setting given this latter. The r.p.m. acts through the pressure retained in front of the restrictor 54 in the stream furnished by the auxiliary control pump 50 in the pressure chamber 27 on the control device. However, the setting acts in the manner depicted through the pretensioning of the spring 28. Through an arbitrary selection of the setting given the restrictor 54, the stream flowing to cylinder 3 through the line 60 can thus be determined.

In a deviating embodiment (not shown in the drawings) the suction line of the auxiliary control pump 50 can be connected to the line 60 so that the stream drawn also influences the speed of movement of the piston 4. However, this is feasible only if the stream drawn is sufficiently large to produce a sufficiently clear pressure head signal on the one hand and to make the loading of shaft 41 achieved by the auxiliary control pump 50 sufficiently large on the other so that if the rod of piston 4 is not loaded by a force, the speed of piston 4 can still be influenced by the setting of the adjustable displacement machine 46.

Figure 4:
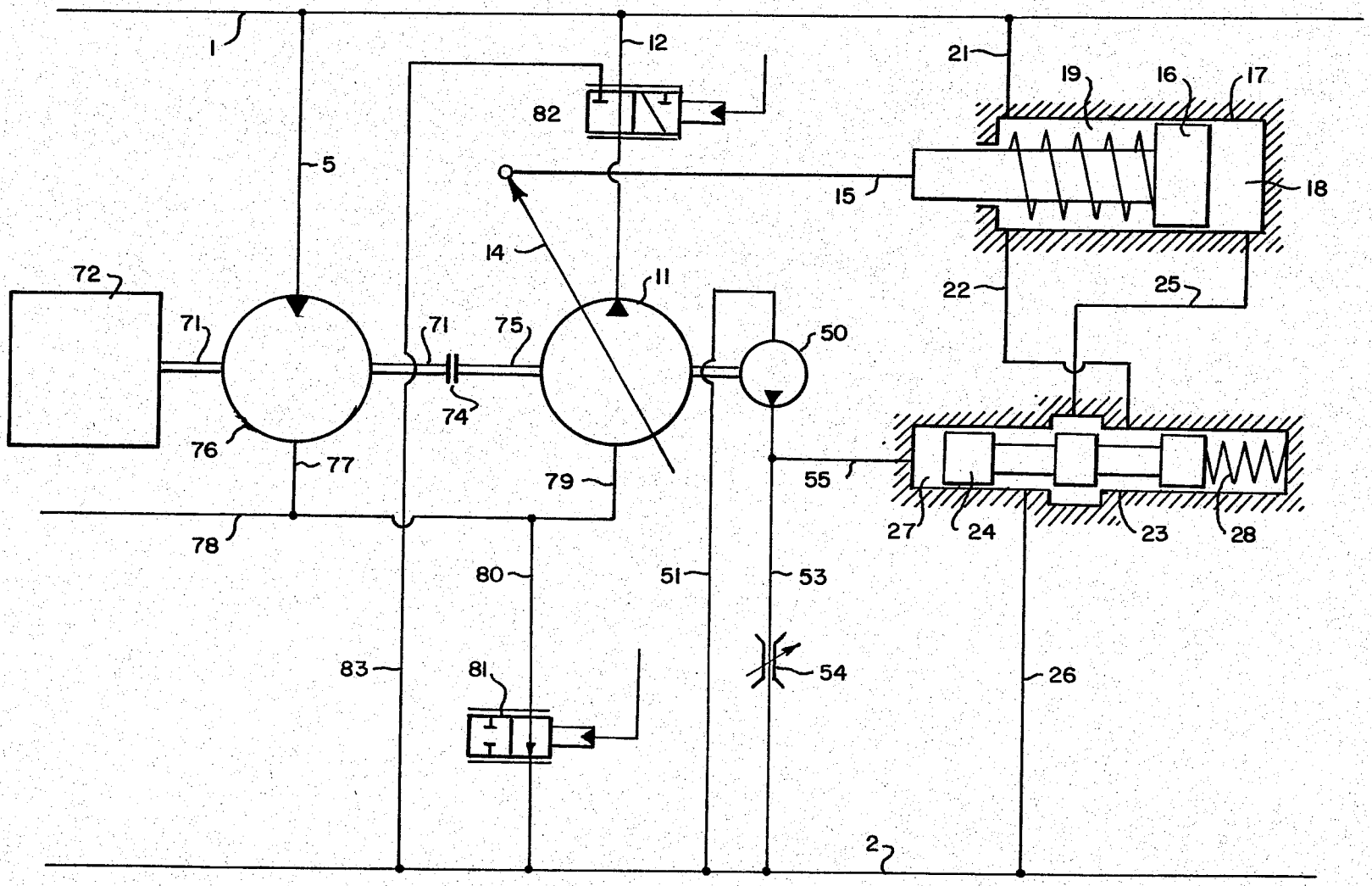
FIG. 4 shows a drive system with a constant-speed motor with rotating shaft.

In the embodiment according to FIG. 4 the components that bear the same reference numbers as the components in preceding figures are also identical to these components shown in the preceding figures.

In the embodiment according to FIG. 4 the hydraulic energy consumer, the speed of movement of which is to be controlled and regulated, is the constant-speed hydraulic motor 76, which drives a load 72 through its shaft 71. The shaft 71 of the constant-speed motor 76 is connected through a cutoff coupling 74 with the shaft 75 of the adjustable hydraulic pump 11, in which case the auxiliary control pump 50 is also connected with the shaft 75. The drain line 77 of the constant-speed hydraulic motor 76 is connected with a return line 78, to which the suction line 79 of the adjustable displacement machine 11 is also connected and to which a line 80 is also connected. An arbitrarily controllable two-position/-two-connection valve (2/2-way valve) 81 is located in line 80 and the latter is connected to the low-pressure line 2 beyond this valve 81. During operation, the differential stream, which is dependent on the setting of pump 11 relative to the stroke volume of hydraulic motor 6 and on the r.p.m. of the shaft 71–75, flows through the line 80. If necessary, the stream flowing through line 80 can also be used at will as an (additional) control signal.

A 2-position/3-connection valve ($\frac{2}{3}$-way valve) is also provided in the line 12; it can be simultaneously actuated with the valve 81 and opens the line 12 in one switching position and closes the line 82, which is connected to the low-pressure line 2, or, in the other switching position, connects the portion of the line 12 lying between pump 11 and valve 82 with the line 83 and closes off the portion of line 12 connected with the pressure system line 1.

If the coupling 74 is closed and valve 81 is in the open position shown and valve 82 is in the position shown, the r.p.m. of the shafts 71 and 75 coupled together through the coupling 74 is determined through the control and regulating arrangement 15–28 and 50–55, and thus the r.p.m. with which the mechanical energy consumer is driven at the shaft 71. The control function corresponds here to that shown in FIG. 2, with the difference that it is not the first displacement machine 46 or 76 that serves to regulate the speed of movement of another consumer (4), but the constant-speed hydraulic motor 76 is itself the consumer that is directly regulated.

In another switching state the coupling 74 is disengaged and the valve 81 is in the closed position and the valve 2 is in the second switching position. The same effect is now functionally achieved as in the embodiment according to FIG. 3, where the adjustable pump 11 appears only at the site of the adjustable pump 46 and the constant-speed hydraulic motor 76 with the load 72 appears at the site of the cylinder 3 with the piston 4.

In contrast to another solution, already proposed in German Application No. P 31 30 660.8, but not published, in which the displacement machine driving the mechanical energy consumer is adjustable and is provided with the speed-regulating arrangement, this tandem connection offers, in spite of the high construction cost, the advantage that it is possible with such an arrangement for one of several consumers to be selectively regulated with only one adjustable unit provided with a regulating device and which necessitates a corresponding expense, because it is possible to connect additional hydraulic energy consumers in the form of constant-speed motors or cylinder-piston systems between the pressure system line 1 and the return line 78 through the lines parallel to the lines 5 and 77, in which case a shutoff valve must be installed only in lines 5 and/or 77 or the lines parallel to them which assures that only one consumer of hydraulic energy is connected in series with the regulated displacement machine 11.

It is shown in FIG. 4 that the line 78 can be extended parallel to the pressure main line. It is thus possible to connect several hydraulic motors corresponding to hydraulic motor 76 between the pressure main line 1 and the return line 78, through a line parallel and corresponding to line 5 and a line corresponding and parallel to line 57. Then if a valve that can be arbitrarily shut off is installed in line 5 and each of the lines connected analogously parallel to it and/or in line 77 and in each of the lines connected analogously parallel to it and if all these constant hydraulic motors can be connected to the coupling 74, it is possible to selectively control and regulate one of several simple and thus inexpensive constant hydraulic motors with respect to its r.p.m. by means of a single adjustable displacement machine 11.

In another implementation form it is not required that the line 78 be extended, but it is possible that, depending on the nature of the machine 72 that is to be driven, one of several constant motors that correspond to the constant motor 76 and are mounted solidly together with a given consumer of mechanical energy and are connected to the coupling 124 is arbitrarily and selectively connected between the lines 5 and 77. Thus, the result is also that each consumer of mechanical energy, which is to be permanently connected solidly with a hydraulic motor, must be connected with only one constant hydraulic motor and, notwithstanding, the constant hydraulic motor incorporated together with the mechanical energy consumer involved can be regulated with regard to its r.p.m. A shaft of a constant hydraulic motor can also be connected to the coupling 74; a cylinder-piston arrangement 3, 4 is connected to the output end of this shaft in accordance with FIG. 1.

Figure 5:
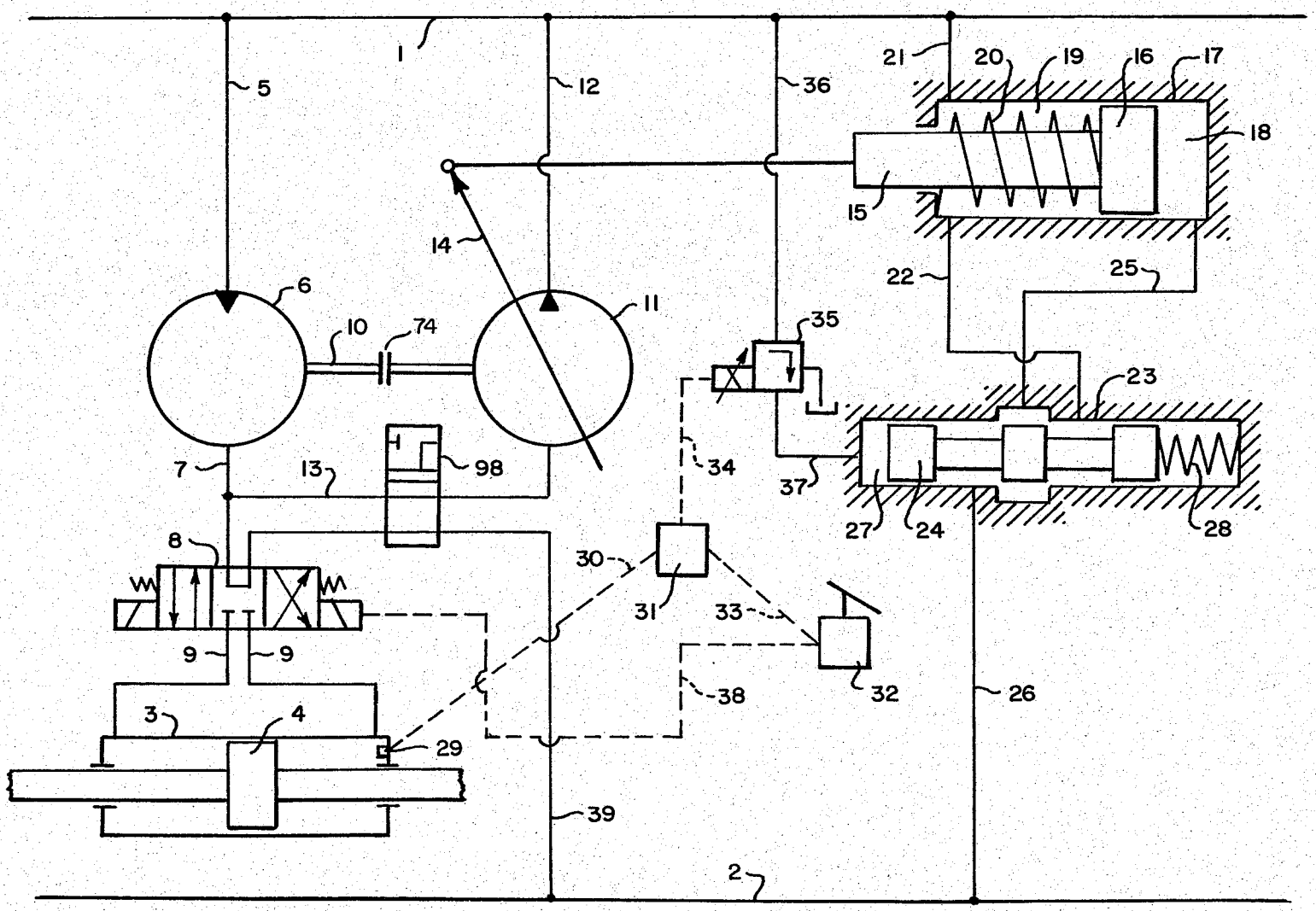
FIG. 5 is another embodiment as a modification of FIG. 1.

The device according to FIG. 5 differs from the device according to FIG. 1 only through the fact that the arbitrarily actuatable valve 98 is additionally provided. In the switch position of this valve shown in the drawing the circuit according to FIG. 1 is produced. In the second possible switching position the suction connection of the adjustable hydraulic pump 11 is connected with the line 39 and the line 13 connected with line 7 is shut off. In this switching state the solution thus corresponds completely to the circuit according to Patent Application No. P 31 30 659.4. It is thus possible with valve 98 to achieve both switching states.

Figure 6:
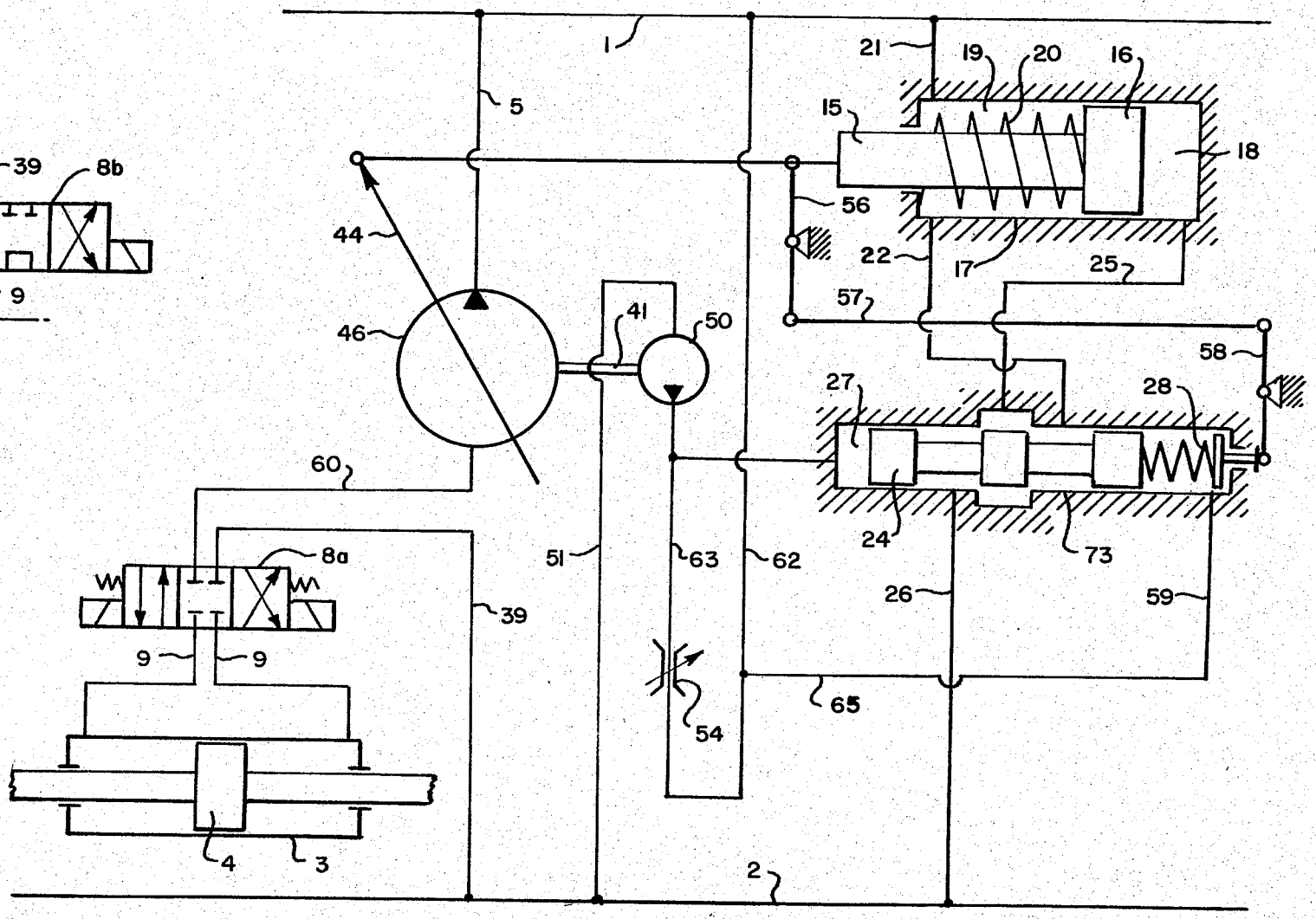
FIG. 6 is another embodiment as a modification of FIG. 3.

The circuit according to FIG. 6 differs from the circuit according to FIG. 3 only in that valve 8*a*, by which both line 60 and line 39, as well as the two lines 9 are shut off in the central position, is installed instead of valve 8.

Figure 7:
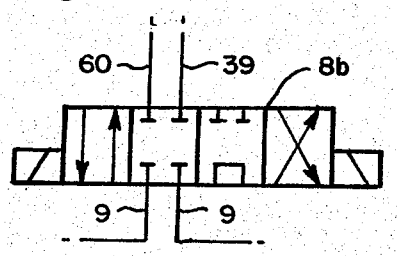
FIG. 7 is a modified valve which may be used in the invention.

FIG. 7 shows another refinement for a valve that can be installed instead of valve 8. In the case of this valve three switching states coincide with the three possible switching states of valve 8*a*. In addition, however, a switching state is possible with this valve 8*b*, in which the two lines 9 are connected together so that the piston 4 in the cylinder 3 can be displaced by an externally acting force.

In the simplest embodiment of the implementation examples, it is sufficient for regulating the speed of movement to arbitrarily regulate the setting of the adjustable unit and to observe the resulting speed of movement.

In the foregoing specification I have set out certain preferred practices and embodiments of this invention, however, it will be understood that this invention may be otherwise embodied within the scope of the following claims.

I claim:

1. A hydrostatic drive comprising a high pressure hydraulic system line, a low pressure hydraulic system line different from the high pressure line, at least one consumer of hydraulic energy in which the ratio of pressure to force is constant connected to said high pressure line, said at least one consumer of hydraulic energy including a constant speed drive means as a first displacement means, a second displacement means drivingly connected to said first displacement means by a rotaty drive shaft, said second displacement means being adjustable with respect to volume output per revolution, volume output adjustment means on said second displacement means, speed regulating means connected to said adjustment means for regulating the speed of the said second displacement means, coupling means coupling adjustable displacement means with the consumer of hydraulic energy and characterized in that the first displacement means, constant with respect to volume per revolution, is a constant speed motor.

2. Drive system according to claim 1, characterized in that the adjustable displacement means is connected with the line feeding the pressure medium to the consumer of hydrostatic energy.

3. Drive system according to claim 2 or 1, in which the consumer of hydraulic energy is a piston capable of sliding in a cylinder, characterized in that a sensor for the position of the piston is located in or on the cylinder, where the signal coming from the sensor acts on a regulating computing unit, which determines a comparison-value signal from the temporal change in the signal for the position of the piston in the cylinder and a theoretical speed value signal and transmits it as a control signal to the adjusting mechanism of the adjustable displacement machine.

4. Drive system according to claim 2 or 1, characterized in that a signal dependent on the setting of the adjustable final control element of the adjustable displacement means acts on the control device, in addition to a speed-dependent signal.

5. A hydrostatic drive comprising a high pressure hydraulic system line, a low pressure hydraulic system line different from the high pressure line, a consumer of hydraulic energy in which the ratio of pressure to force is constant connected to said high pressure line, a first displacement means connected to said consumer of hydraulic energy between said high pressure hydraulic line and said consumer, a second displacement means connected to said first displacement means by a rotary drive shaft, one of said first and second displacement means being adjustable with respect to volume output per revolution, volume output adjustment means on said one displacement means, speed regulating means, connected to said adjustment means for regulating the speed of the said displacement means, coupling means coupling said one adjustable displacement means with the consumer of hydraulic energy, said adjustable displacement means being connected with the line feeding the pressure medium to the consumer of hydrostatic energy and said consumer being a piston capable of sliding in a cylinder and said first constant displacement means being connected into the feed line to the latter, the shaft of which is coupled with said second displacement means which is adjustable, and wherein a suction connection of the second displacement machine is connected with the connecting line between the first displacement machine and the cylinder.

6. A hydrostatic drive comprising a high pressure hydraulic system line, a low pressure hydraulic system line different from the high pressure line, at least one consumer of hydraulic energy in which the ratio of pressure to force is constant connected to said high pressure line, said at least one consumer of hydraulic energy including a constant speed drive means as a first displacement means, a second displacement means drivingly connected to said first displacement means by a rotary drive shaft, said second displacement means being adjustable with respect to volume output per revolution, volume output adjustment means on said second displacement means, speed regulating means connected to said adjustment means for regulating the speed of the said second displacement means, coupling means coupling said adjustable displacement means with the consumer of hydraulic energy, said consumer of hydraulic energy being a constant-speed motor, which also acts as the first displacement means, characterized in that the said constant-speed motor is coupled with a shaft of the adjustable second displacement means and said constant-speed motor and said second displacement means are hydraulically connected, one behind the other.

7. Drive system according to claim 6, characterized in that a cutoff coupling is located in the shaft between the constant-speed motor and the second displacement means and that a drain line of the consumer in a closed system can be connected to a suction line of the second displacement means and a bypass valve in the connection to the high-pressure hydraulic system line from the second displacement means and a second connection of the second displacement means from the bypass valve whereby the second displacement means can be separated from the pressure system line and connected with the low-pressure system line.

8. Drive system according to claim 7, characterized in that one of several consumers of hydraulic energy in the closed system can at will be serially connected with the second displacement means.

* * * * *